United States Patent [19]

Feldkämper et al.

[11] Patent Number: 4,482,145

[45] Date of Patent: Nov. 13, 1984

[54] APPARATUS FOR SUPPLYING SUCTION AIR TO ROTARY APPLICATOR

[75] Inventors: Richard Feldkämper, Lengerich; Bernhard Philipp, Ibbenbüren, both of Fed. Rep. of Germany

[73] Assignee: Windmoller & Holscher, Lengerich, Fed. Rep. of Germany

[21] Appl. No.: 485,904

[22] Filed: Apr. 18, 1983

[30] Foreign Application Priority Data

Apr. 19, 1982 [DE] Fed. Rep. of Germany ..... 3214342

[51] Int. Cl.[3] ..... B65H 3/12

[52] U.S. Cl. ..... 271/95; 271/108

[58] Field of Search ..... 271/94, 95, 99, 108

[56] References Cited

U.S. PATENT DOCUMENTS 2,915,308 12/1959 Matzen ..... 271/95 X 3,302,946 2/1967 Anderson ..... 271/95

3,937,458 2/1976 Langen ..... 271/95

4,350,466 9/1982 Bahr ..... 271/95 X

*Primary Examiner*—Richard A. Schacher

*Attorney, Agent, or Firm*—Fleit, Jacobson, Cohn & Price

[57] ABSTRACT

An apparatus for supplying suction air to a rotary applicator comprises suction rollers planetating about a central shaft. Each suction roller carries suckers arranged in an axial row and the shafts of which are mounted in spaced discs secured on the central shaft. Two control valve discs connect the conduits leading to the suckers to a conduit leading to a suction air pump over a zone corresponding to an approximate angle of rotation of 90° of the discs. The first control valve disc is formed directly by one of the discs mounting the suction roller shafts and the second control valve disc is secured in the frame and held in sealing sliding contact with the disc.

14 Claims, 16 Drawing Figures

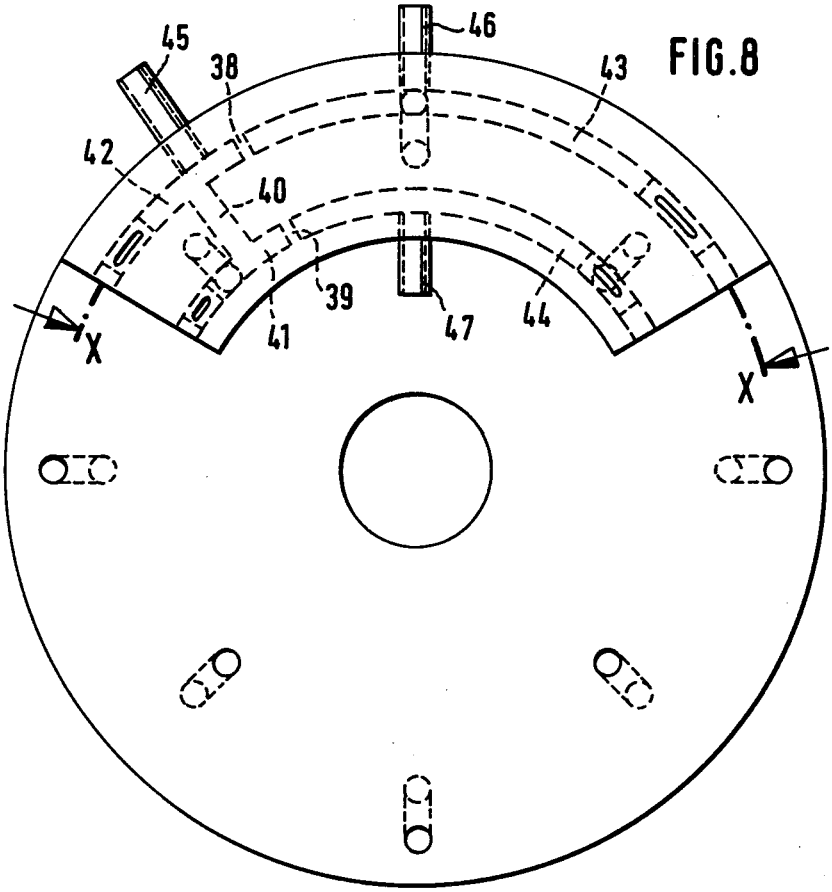
FIG.8
FIG.9
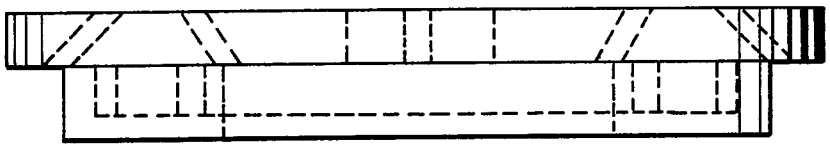
FIG.10
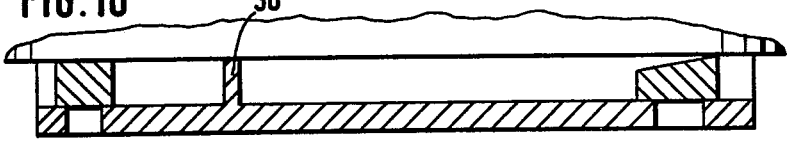

APPARATUS FOR SUPPLYING SUCTION AIR TO ROTARY APPLICATOR

The invention relates to an apparatus for supplying suction air to a rotary applicator, comprising suction rollers which planetate about a central shaft, each carry suckers arranged in an axial row and the shafts of which are mounted in spaced discs secured on the central shaft, and a rotary transmission consisting of two control valve discs for connecting the conduits leading to the suckers to a conduit leading to a suction air pump over a zone corresponding to an approximate angle of rotation of 90° of the discs.

In an apparatus of this kind known from DE-AS 12 77 655, one control valve disc is secured to a side wall of the machine frame coaxially with the central shaft whereas the other control valve disc turns together with the disc mounting the suction roller shafts and is sealingly pressed by compression springs against the fixed control valve disc. The rotating control valve disc is provided by conduits with connecting members for the suction roller shafts secured to the disc, the connecting members being provided with lever-actuated valves which co-operate with fixed cam segments for controlling the suction air. The known apparatus for supplying suction air is therefore comparatively complex because, apart from the rotary transmission consisting of the two control valve discs, the control of suction air requires control valves to be associated with each of the individual suction roller shafts, the actuating levers of the control valves being controlled by fixed control cams.

It is therefore the problem of the invention to provide an apparatus for supplying suction air to a rotary applicator that is simpler than the known apparatus.

According to the invention, this problem is solved in that the first control valve disc is formed directly by one of the discs mounting the suction roller shafts and the second control valve disc is secured in the frame and held in sealing sliding contact with the disc. The apparatus according to the invention permits the supply of suction air through only one control valve disc which slides over the disc mounting the suction roller shafts and is sector shaped, it being possible at the same time to obtain extremely accurate control of the suction air supply by the length of the suction air groove provided in the control valve disc.

Usually, eight suction rollers are mounted in the discs secured to the central shaft, each suction roller executing one complete rotation over a zone corresponding to a turning angle of the discs of 90°. Since the radially outwardly directed positions of the suckers correspond to the receiving and delivery stations in this zone, suction air has to be supplied to the suckers in this construction substantially through an angle of rotation of the discs of 90°. With a different number of suction rollers or different rotary speeds of the suction rollers relatively to the supporting discs, the angular zone over which suction air has to be supplied to the suction rollers must be changed accordingly.

It is also a disadvantage in the known apparatus that the control valve discs are pulled together by the suction air so that the pressure with which the control valve discs are slidingly superposed cannot be accurately set by the compression springs. A development of the invention therefore provides that the second control valve disc is mounted in the frame for limited axial displacement parallel to the central shaft and is provided with a pressure compensating disc which has a bore communicating with the suction air conduit and is sealed from a fixed plate or the like by bellows, telescopic annular members or the like. Desirably, the size of the pressure compensating disc is such that it substantially compensates the second control valve disc against the force sucking the disc which mounts the suction roller shafts and that the second control disc is pressed against the disc by compression springs. Since the forces arising from the suction air are compensated, the pressure of application of the second control valve disc can be set finely by the compression springs alone.

Particularly good separation of the workpieces is obtained if each row of suckers is substantially alone connected to a vacuum pump or source of suction air. A development of the invention therefore provides that the disc mounting the suction roller shafts is provided on the side opposite to the suction rollers alternately on two concentric circles with suction air bores which have a different radial spacing from the central shaft and are associated with the respective successive suction rollers, that the second control valve disc is provided with two concentric suction air grooves associated with each of the suction air bores arranged on the two concentric circles, and that the length of each of the suction air grooves is such that the preceding suction air bore of the disc is just closed as the following one enters the groove.

Other advantageous constructions of the invention have been described in the subsidiary claims.

One example of the invention will now be described in more detail with reference to the drawing, wherein:

FIG. 8 is a view corresponding to FIG. 3 of a further embodiment of disc;

FIG. 9 is a plan view of the FIG. 8 disc;

FIG. 10 is a section through the suction groove taken on the line X—X in FIG. 8;

Figure 1:
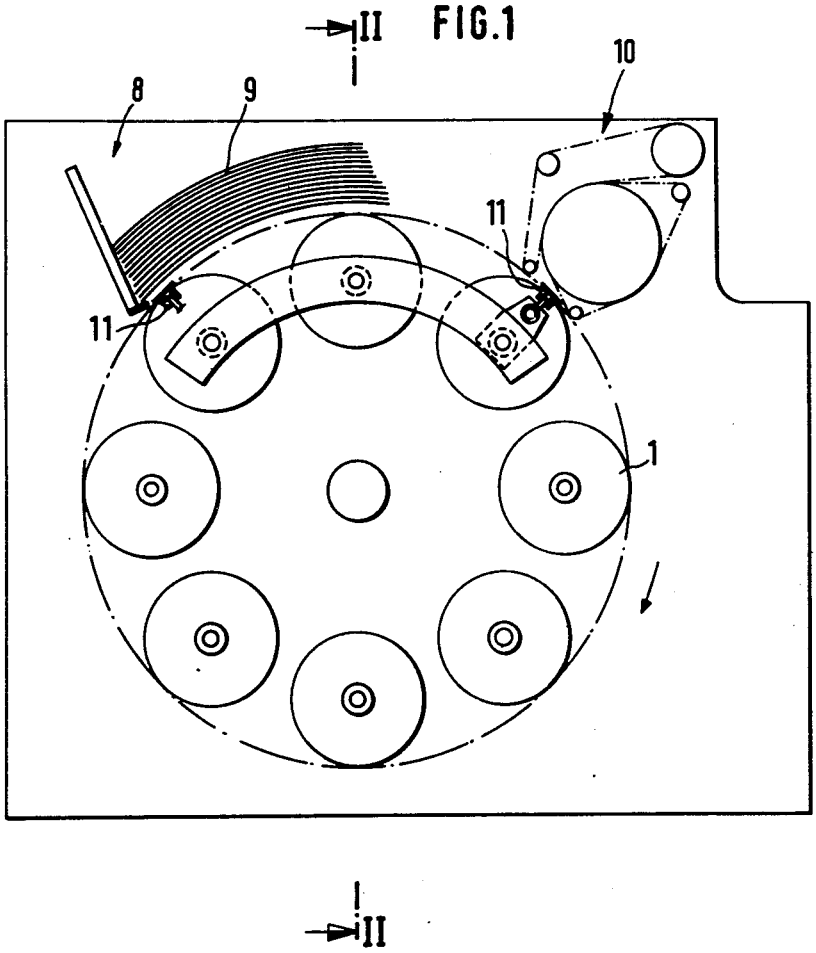
FIG. 1 is a diagrammatic side elevation of the rotary applicator.
Figure 2:
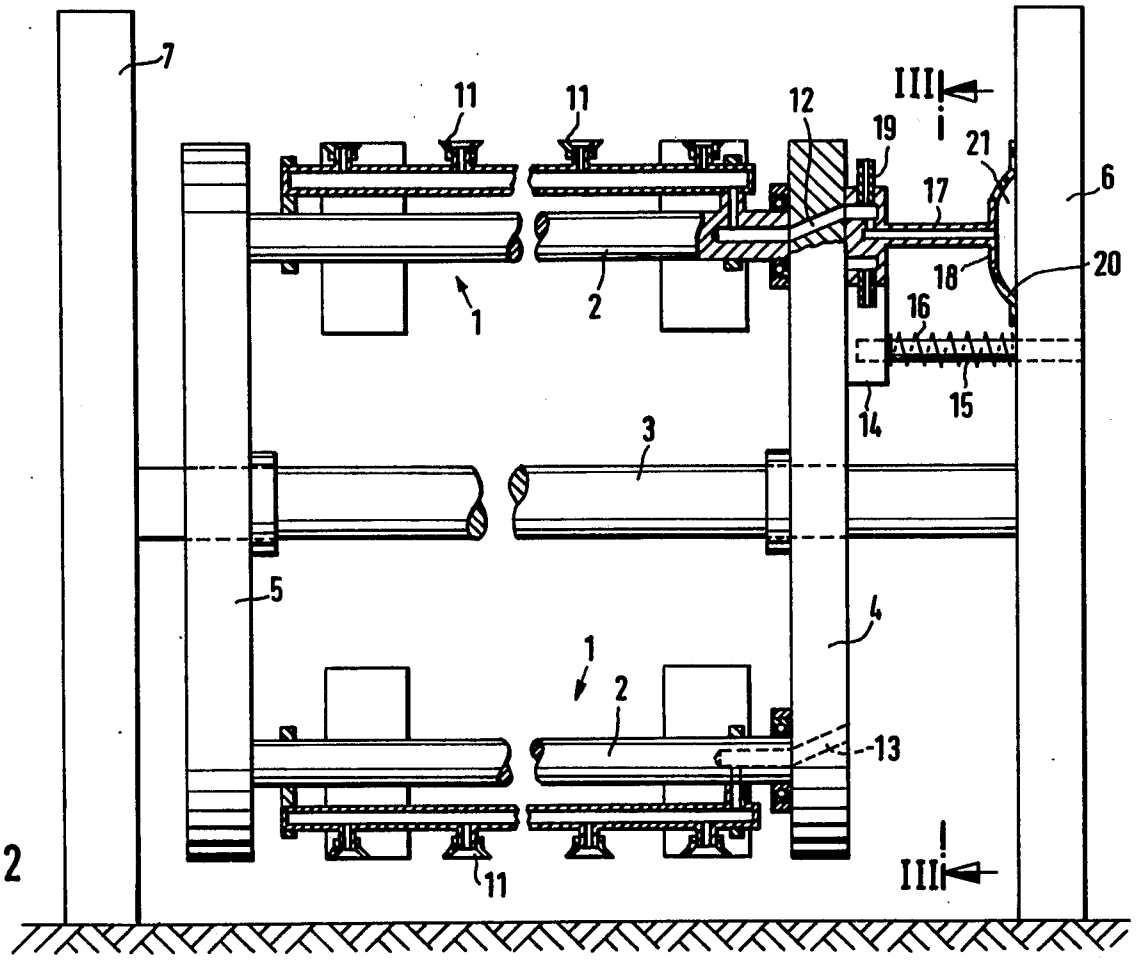
FIG. 2 is a part-sectional front elevation of the rotary applicator on the line II—II in FIG. 1.

The rotary applicator shown in FIGS. 1 and 2 comprises eight suction rollers 1 of which the shafts 2 are mounted at equal radial spacings from the central shaft 3 in discs 4, 5 secured to the central shaft 3. The central shaft 3 is mounted in the side members 6, 7 of the machine frame. For the sake of clarity, the planet gearing for driving the suction rollers and corresponding to that described in DE-AS 12 77 655 has been omitted.

Above the enveloping cylinder described by the suction rollers 1, there is a stacking magazine 8 containing a stack 9 of sacks or the like which are to be separated. The delivery station 10 consisting of means for taking the individual workpieces from the suckers 11 and the diagrammatically illustrated double belt conveyor is arranged at a spacing from the stacking magazine 8 corresponding to an angle of rotation of 90° of the discs 4, 5. As will be evident from FIG. 1, the rows of suckers consisting of the suckers 11 always withdraw the lowermost workpiece from the stacking magazine 8 and transfer it to the delivery station 10 after one rotation of the suction rollers.

The right-hand disc 4 in FIG. 2 mounting the suction roller shafts 2 is provided with oppositely obliquely extending suction bores 12, 13 and in the form of a control valve disc. On the inside of the disc 4, the suction bores 12, 13 open on a circle concentric with the central shaft 3 and are in registry with the axial suction bores in the suction roller shafts 2 to which they are connected by conventional rotary transmissions.

The control valve disc 14 sliding on the disc 4 is guided for axial displacement by way of bolts 15 and 16 and is pressed against the disc 4 by compression springs 16 which are placed over the bolts 15 and are supported on the one hand on the control valve disc 14 and on the other hand by the machine frame 6.

The control valve disc 14 is provided with a tube 17 which is parallel to the bolts 15 and carries a pressure compensating disc 18 on the side facing the frame wall 6. The tube 17 and the pressure compensating disc 18 are provided with a suction bore communicating with the nipple 19 which serves as a connection to a vacuum pump. The pressure compensating disc is sealed from the side wall 16 of the frame by bellows 20 of elastic or flexible material bounding a chamber 21 in which there is the same vacuum as in the suction air conduits.

Figure 5:
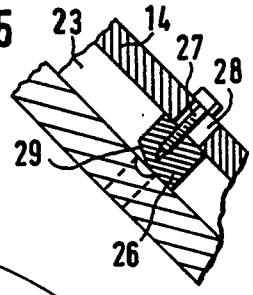
FIG. 5 is a section through the suction groove taken on the line V—V in FIG. 3.
Figure 3:
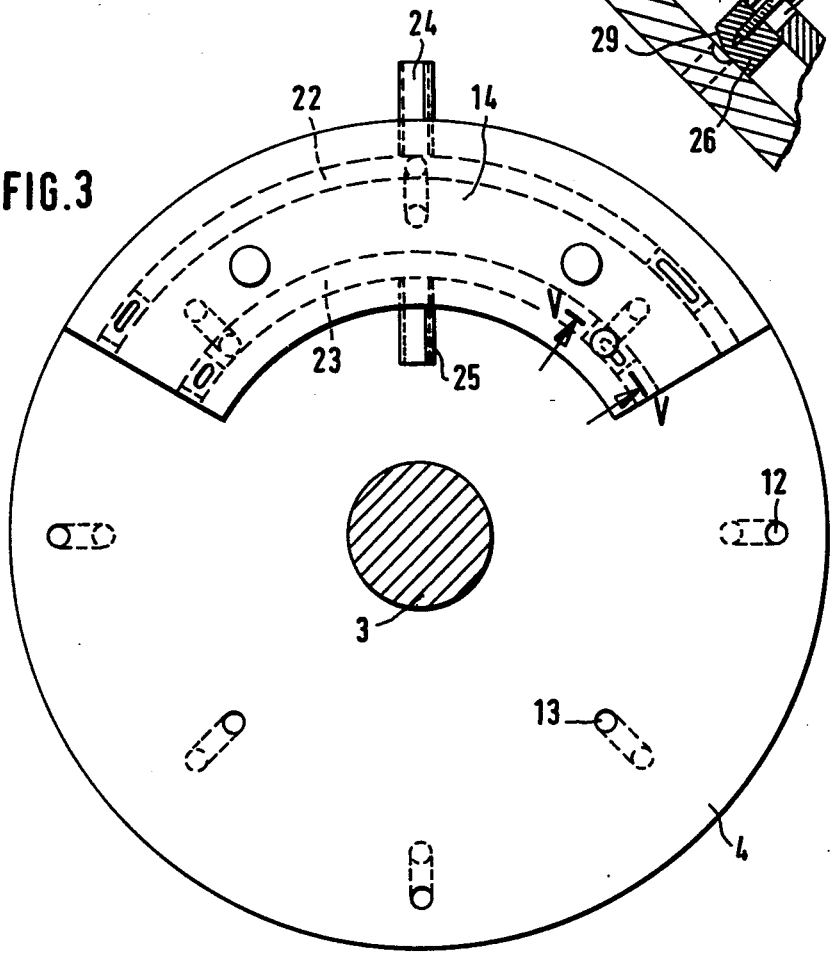
FIG. 3 is a front elevation of the disc mounting the suction roller shafts taken on the line III—III in FIG. 2.
Figure 4:
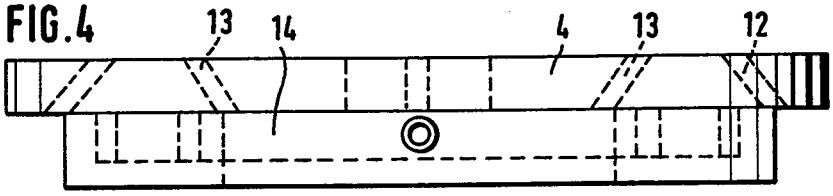
FIG. 4 is a plan view of the FIG. 3 disc.

In the embodiments of FIGS. 3 to 5, the suction air bores 12, 13 alternately open on the outside of the disc 4 on circles which are concentric with the central shaft 3 and have different radii. On the inside of the disc 4, the suction air bores are disposed on a concentric circle and are in registry with the axial suction air bores of the suction roller shafts.

The control valve disc which is applied to the disc 4 and slides thereon has the shape of an annular sector and is provided on the side facing the disc 4 with two arcuate concentric suction air grooves 22, 23 each disposed on one of the circles described by the mouths of the suction air bores 12, 13. Each of the suction air grooves 22, 23 communicates with a vacuum pump by way of connecting nipples 24, 25. The grooves 22, 23 are closed at the end by closing blocks 26 which are fixed by screws 27 which, for the purpose of adjusting the closing blocks 26, pass through elongated holes 28 of the control valve disc. Towards the suction air grooves, the closing blocks 26 are provided with chamfers 29 which, when passing over the suction air bores, bring about gradual closing. The spacing of the closing blocks 26 is such that, as a suction air bore enters the suction air groove, the preceding suction air bore is just leaving the groove.

Figure 6:
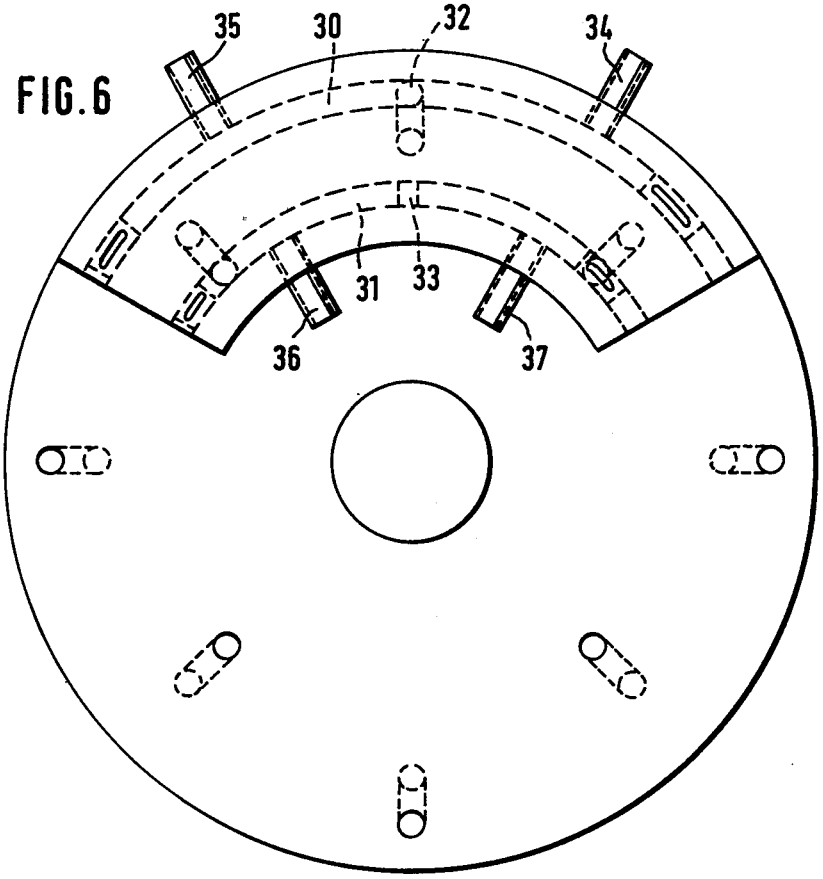
FIG. 6 is a view corresponding to FIG. 3 of a different embodiment of disc.
Figure 7:
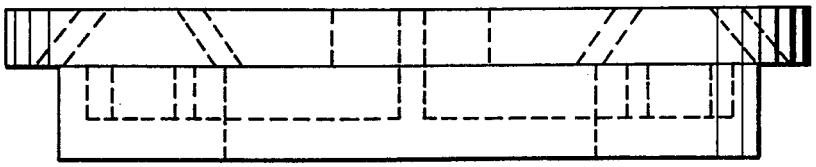
FIG. 7 is a plan view of the FIG. 6 disc.

The example of FIGS. 6 and 7 differs from the FIGS. 3 and 4 example substantially in that the suction air grooves 30, 31 are divided in their central zone by webs 32, 33 to form four suction air grooves connected to their own vacuum pumps by respective connecting nipples 34 to 37.

In the example of FIGS. 8 to 10, the suction air grooves are sub-divided closely behind the entry zone by intermediate webs 38, 39 so that short suction air grooves 41, 42 are formed on the entry side and longer suction air grooves 43, 44 on the outlet side. The short suction air grooves 41, 42 are interconnected by a groove or bore 40. The suction air groove 42 as well as the suction air grooves 43 and 44 are provided with connecting nipples 45 to 47 by which the suction air grooves are connected to associated vacuum pumps.

Figure 11:
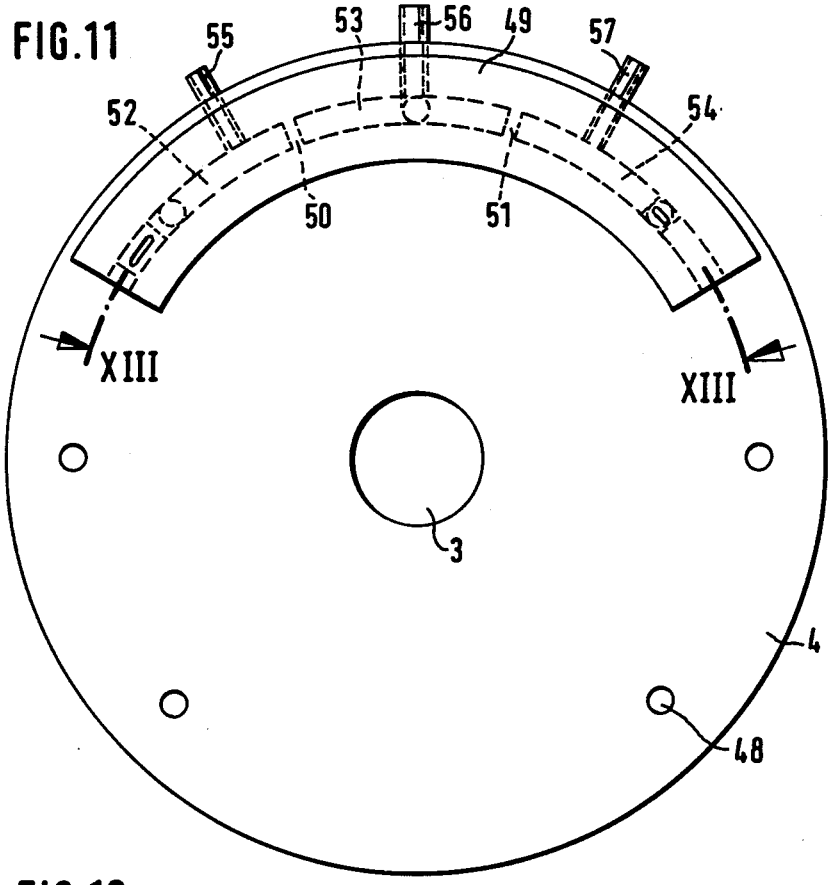
FIG. 11 is a plan view of a further embodiment of disc.
Figure 12:
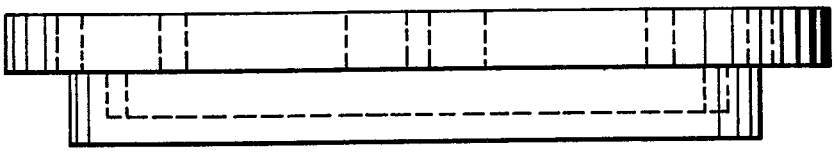
FIG. 12 is a plan view of the FIG. 11 disc.
Figure 13:
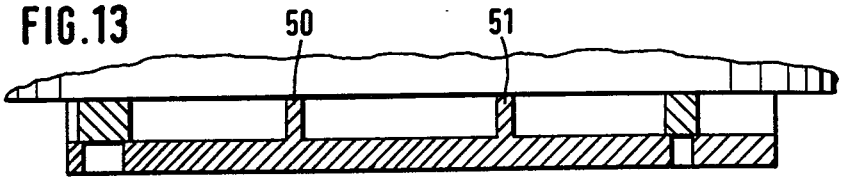
FIG. 13 is a section through the suction groove taken on the line XIII—XIII in FIG. 11.

In the example of FIGS. 11 to 13, the suction air bores 48 open on both sides of the disc 4 on a circle concentric with the central shaft 3. The valve control disc 49 has only one suction air groove which is arcuately curved at such a radius that it is swept by the suction air bores 8. The suction air groove is closed at the ends by closing blocks and at its central region by webs 50, 51 to form suction air groove segments 52, 53, 54. Each of these segments is provided with connecting nipples 55 to 57 connected to vacuum pumps.

Figure 14:
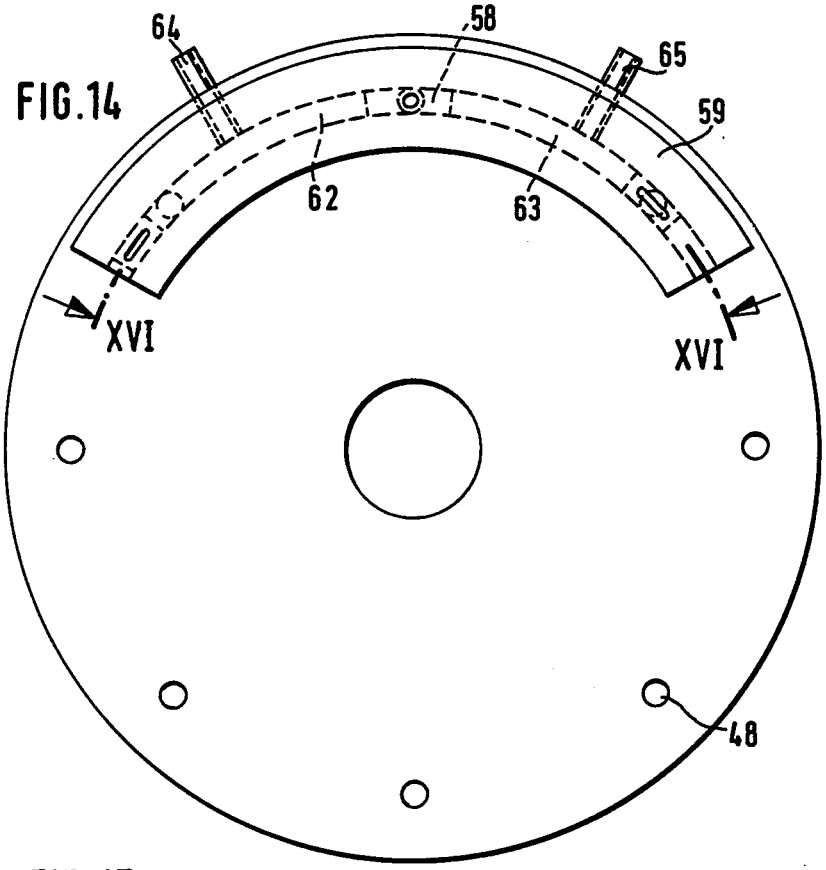
FIG. 14 is a plan view of a last embodiment of a disc.
Figure 15:
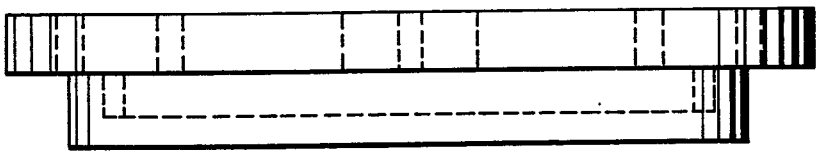
FIG. 15 is a plan view of the FIG. 14 disc.
Figure 16:
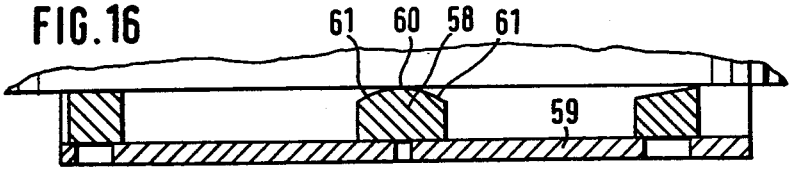
FIG. 16 is a section through the suction groove taken on the line XVI—XVI in FIG. 14.

The FIGS. 14 to 16 example differs from that of FIGS. 11 to 13 in that the suction air groove is interrupted in its central region by a closing block 58 of which the central portion 60 flush with the edge of the control valve disc 59 is longer than the diameter of the suction air bores 48. At the ends, the closing block 58 is provided with chamfers 61. By means of the closing block 58, the suction air groove is sub-divided into sections 62, 63 connected to two vacuum pumps by way of connecting nipples 64, 65.

We claim:

1. Apparatus for supplying suction air to a rotary applicator, comprising suction rollers which planetate about a central shaft, each carry suckers arranged in an axial row and the shafts of which are mounted in spaced discs secured on the central shaft, and a rotary transmission consisting of two control valve discs for connecting the conduits leading to the suckers to a conduit leading to a suction air pump over a zone corresponding to an approximate angle of rotation of 90° of the discs, characterised in that the first control valve disc is formed directly by one of the discs (4) mounting the suction roller shafts (2) and the second control valve disc (14) is secured in the frame (6) and held in sealing sliding contact with the disc (4).

2. Apparatus according to claim 1 characterised in that the second control valve disc (14) is mounted in the frame (6) for limited axial displacement parallel to the central shaft (3) and is provided with a pressure compensating disc (18) which has a bore communicating with the suction air conduit (19) and is sealed from a fixed plate or the like by bellows (20), telescopic annular members or the like.

3. Apparatus according to claim 2, characterised in that the size of the pressure compensating disc (18) is such that it substantially compensates the second control valve disc against the force sucking the disc which mounts the suction roller shafts, and that the second control disc (14) is pressed against the disc (4) by compression springs (16).

4. Apparatus claim 1, characterised in that the disc mounting the suction roller shafts is provided on the side opposite to the suction rollers (1) alternately on two concentric circles with suction air bores (12, 13) which have a different radial spacing from the central shaft (3) and are associated with the respective successive suction rollers (1), and that the second control valve disc (14) is provided with two concentric suction air grooves (22, 23) associated with each of the suction air bores (12, 13) arranged on the two concentric circles, and that the length of each of the suction air grooves (22, 23) is such that the preceding suction air bore of the disc (4) is just closed as the following one enters the groove (22, 23).

5. Apparatus according to claim 4, characterised in that the grooves (22, 23) are closed at the ends by blocks (26) connected to the second valve control disc (14) by screws (27) passing through elongated holes (28) therein for adjustment in the circumferential direction.

6. Apparatus according to claim 5, characterised in that the blocks (26) are provided on the outlet side of the grooves (22, 23) with chamfers (29) directed towards the grooves.

7. Apparatus claim 4, characterised in that each suction air groove (22, 23) is connected to its own suction air source.

8. Apparatus claim 4, characterised in that each of the suction air grooves is provided in its central zone with a sealing intermediate web (32, 33) and each of the four suction air grooves is connected to its own source of suction air.

9. Apparatus claim 4, characterised in that the entry zones of the suction air grooves are separated from the subsequent zones (43, 44) by intermediate webs (38, 39), are interconnected by a groove or bore (40) and are connected to a suction air source, and that each of the subsequent zones (43, 44) of the suction air grooves is connected to a separate source of suction air.

10. Apparatus claim 1, characterised in that the disc (4) mounting the suction roller shafts is provided with a row of suction air bores (48) arranged on only one circle and the second valve control disc (49) is provided with a complementary suction air groove which is closed at the end and is interrupted at its central region by two intermediate webs (50, 51) to create three successive suction air grooves (52, 53, 54) of substantially equal length, and that each of the three suction air grooves (52, 53, 54) is connected to its own suction air source.

11. Apparatus according to claim 10, characterised in that the webs (50, 51) sub-dividing the suction air groove are narrower than the diameter of the suction air bores (48) in the disc (4).

12. Apparatus claim 1, characterised in that the disc (4) mounting the suction roller shafts is provided with a row of suction air bores (48) arranged on only one circle and the second control valve disc (59) is provided with a complementary suction air groove which is closed at the ends and is interrupted at its central region by an intermediate web (58) so that two successive suction air grooves (62, 63) of substantially the same length are created, and that each of the two suction air grooves (62, 63) is connected to its own source of suction air.

13. Apparatus according to claim 12, characterised in that the central zone of the web (58) sub-dividing the suction air groove and flush with the edge of the valve control disc is broader than the diameter of the suction air bores (48) in the disc.

14. Apparatus claim 12, characterised in that the web (58) sub-dividing the suction air groove is concically bevelled at both end zones (61).

* * * * *